United States Patent [19]

Polanecky

[11] Patent Number: 4,681,020

[45] Date of Patent: Jul. 21, 1987

[54] CONTROL FOR A DETENT FOR A SLIDE FOR AUTOMATIC FIREARMS, ESPECIALLY FOR AUTOMATIC PISTOLS

[75] Inventor: Vaclav Polanecky, Nivnice, Czechoslovakia

[73] Assignee: Agrozet, koncernovy podnik, Uhersky Brod, Czechoslovakia

[21] Appl. No.: 656,038

[22] Filed: Sep. 28, 1984

[30] Foreign Application Priority Data

Sep. 30, 1983 [CS] Czechoslovakia ..... 7153-83

[51] Int. Cl.[4] ..... F41D 11/06; F41C 17/08

[52] U.S. Cl. ..... 89/138; 89/196; 42/70.02

[58] Field of Search ..... 89/137, 138, 196; 42/7, 42/70.01, 70.02, 70.11, 70.04, 70.05

[56] References Cited

U.S. PATENT DOCUMENTS

| | | | |
|---|---|---|---|
| 956,431 | 4/1910 | Schmeisser | 89/196 |
| 992,854 | 5/1911 | Cobb | 89/196 |
| 1,355,423 | 10/1920 | Pedersen | 89/138 |
| 1,638,068 | 8/1927 | Tansley | 89/137 |
| 2,529,359 | 11/1950 | Stevens | 89/196 |
| 2,664,786 | 1/1954 | Guisasola | 42/7 |
| 2,786,293 | 3/1957 | Cook | 42/70.04 |
| 3,492,748 | 2/1970 | Swenson | 42/70.01 |
| 4,282,795 | 8/1981 | Beretta | 89/148 |
| 4,414,769 | 11/1983 | Mueschke | 42/70.01 |
| 4,481,863 | 11/1984 | Zanner et al. | 89/138 |

FOREIGN PATENT DOCUMENTS

| | | | |
|---|---|---|---|
| 634577 | 8/1936 | Fed. Rep. of Germany | 42/70.02 |
| 2443553 | 3/1976 | Fed. Rep. of Germany | 89/138 |
| 2137324 | 10/1984 | United Kingdom | 42/70.01 |

*Primary Examiner*—Charles T. Jordan
*Assistant Examiner*—Stephen M. Johnson

[57] ABSTRACT

An automatic firearm such as an automatic pistol having a slide and a thumb-engageable control on each side of the firearm for selectively securing the slide in retracted, inoperative position. This permits the firearm to be operated with equal facility and speed by either a right-handed or a left-handed marksman. A detent for retaining the slide in retracted position is mounted within the frame of the firearm for selective cooperation with a latch. A cross pin mounted for oscillation in the frame of the firearm has a lever mounting the detent fixedly connected thereto. Fixedly connected to one end of the pin outwardly of the frame of the firearm on a first side thereof there is a radially extending first detent control arm. On the other, second end of the pin, on the other side of the frame there is removably attached a second detent control arm, preferably identical with the first control arm, and disposed in the same angular position with respect to the pin.

5 Claims, 7 Drawing Figures

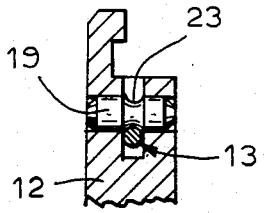
FIG. 5
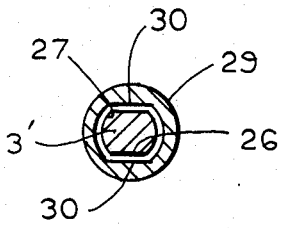
FIG. 6
FIG. 7
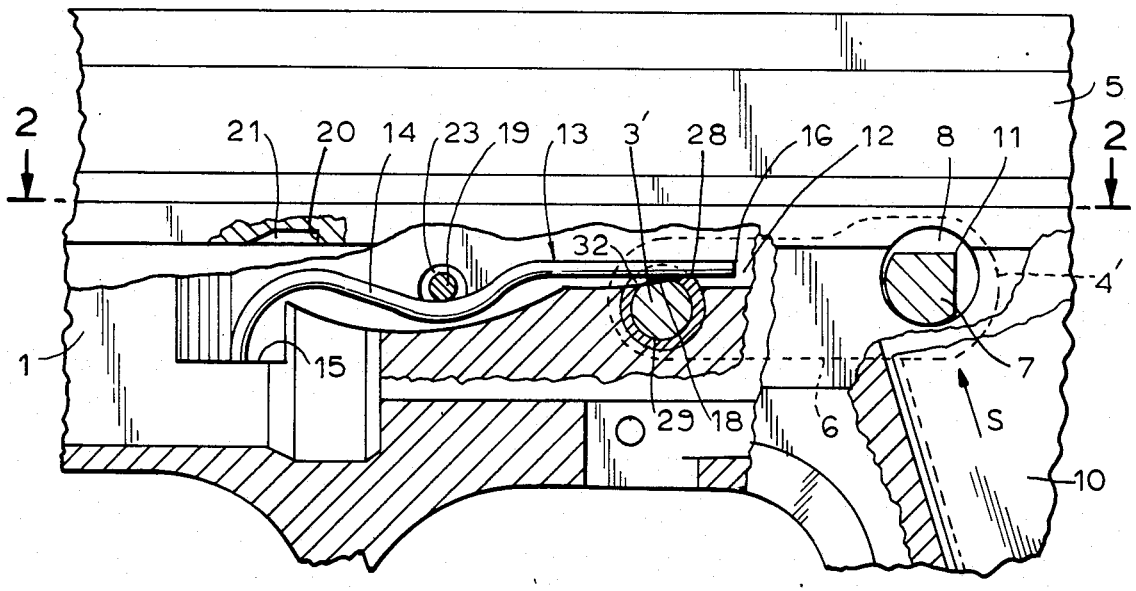

CONTROL FOR A DETENT FOR A SLIDE FOR AUTOMATIC FIREARMS, ESPECIALLY FOR AUTOMATIC PISTOLS

This invention relates to a control for a detent or catch for a slide for automatic firearms, especially for automatic pistols. In accordance with the present invention, the detent for the slide is controlled both from the right and the left sides of the firearm, in order to insure fast operation of the firearm by an either right-handed or left-handed person.

Hitherto know embodiments of the control for the catch or detent for the slide of an automatic pistol are mostly in the shape of a single-arm lever, which is provided with a claw or locking detent which is operated by cartridges said to the breech of the pistol fed by a spring from a cartridge magazine. This arrangement insures speed of firing, since the pistol user is informed by the opened slide of the pistol that the last cartridge of the cartridge magazine has been fired. After the cartridge magazine has been changed, the firearm is ready for firing upon the pressing of a control push button for the lever which operates the catch or detent for the slide.

There is a drawback in such embodiment, viz. in that the advantage of quick firing of up-to-date automatic firearms cannot be utilized by left-handed marksmen, because the firearm, e.g. the automatic pistol, is provided with a single sided control for the lever operating the detent for the slide, viz. from the left side of the pistol for the thumb of the right hand. It is impossible for a left-handed marksman to control the push button of the slide detent by the thumb of his left hand without a simultaneous loosening of his firm grip upon the pistol.

Nowadays the number of left-handed marksmen is increasing, and that is why a two-sided control of a slide detent of an automatic pistol is very much needed because firing quickness is a very actual necessity in the use of such weapon.

The slide detent usually secures not only quickness of firing, but also other functions as well, as e.g. the locking of the barrel and slide of the weapon together, and the locking of the weapon against accidental dismantling.

Some of the above disclosed drawbacks of the prior art are obviated, or at least mitigated, by the slide detent control of the present invention. In accordance with the invention, there is provided a two-sided control for the slide detent of automatic firearms, especially for pistols, whereby the weapon can be used with equal facility by either a right-handed or left-handed marksman. The control for a slide detent for an automatic firearm is illustrated herein in connection with an automatic pistol provided with a first detent controlling lever, a slide detent, and a pin with a cylindrical groove which receives and elongated spring seated in the frame of the firearm. The second control of the slide detent, in accordance with the invention, is created by providing a collar which is slid on the pin, the collar provided with controlling lever, the collar having an arcuate transverse slot therein which receives the portion of the spring which is seated in the groove of the pin.

The advantage of the invention resides in the fact that it is possible to control the slide detent of the automatic weapon not only by the right, but also by the left hand of the marksmen, while maintaining other functions of the firearms which the slide detent performs, such as the locking of the barrel of the weapon onto the slide thereof, and the functioning of the slide detent as an assembling and disassembling lock. The construction of the detent control of the present invention is simple, foolproof, and such that it is economical to produce.

In order that the invention may be clearly understood and readily carried into effect, a preferred embodiment thereof is, by way of example, here and after more fully described and illustrated in the accompanying drawings, in which:

FIGS. 1 and 7 are fragmentary views, partially in side elevation and partially in vertical axial section through a machine pistol in accordance with the prior art, such machine pistol being adapted for use by a right-handed marksman;

Figure 1:
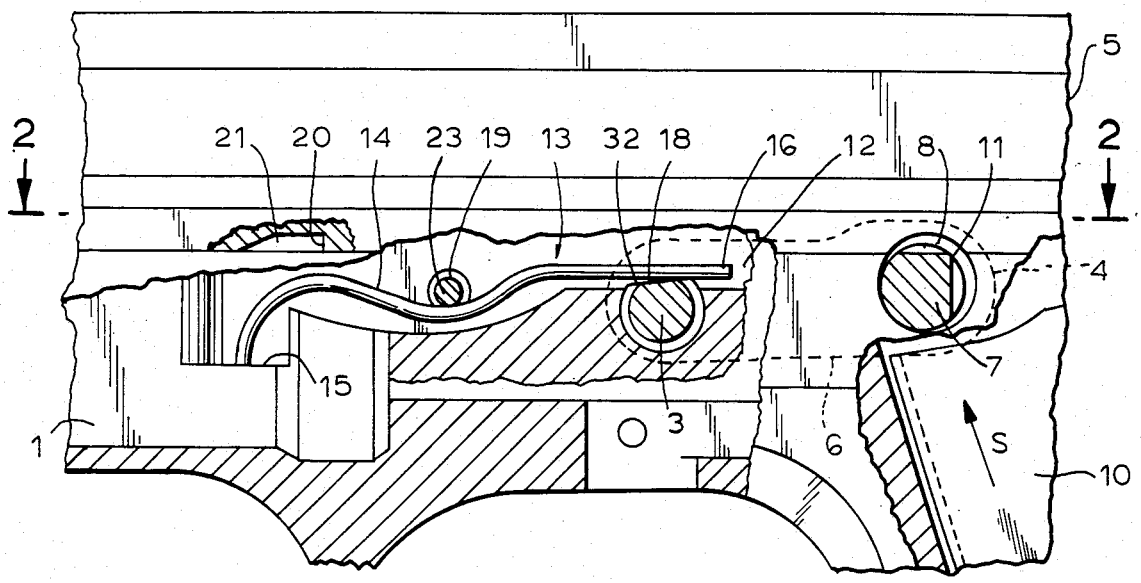
FIG. 1 PRIOR ART
Figure 2:
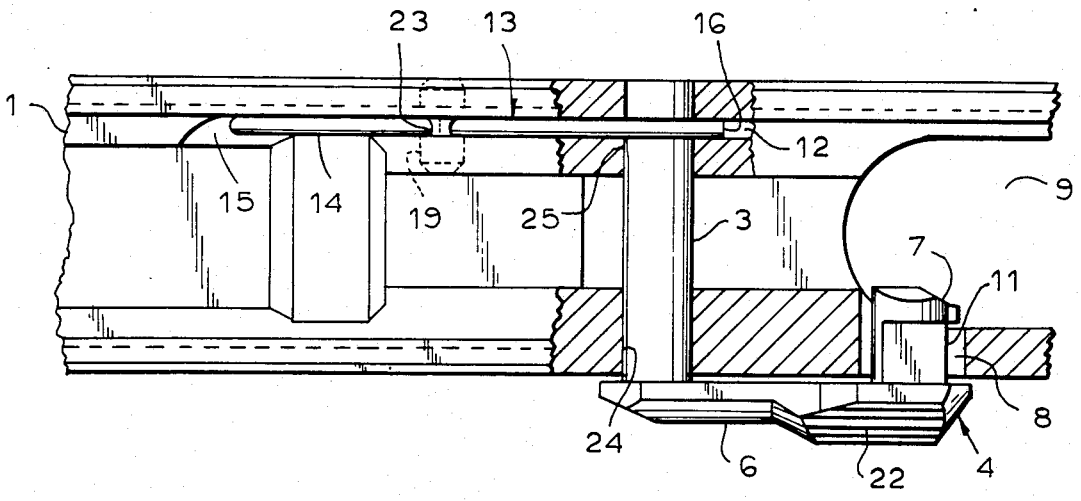
FIG. 2 PRIOR ART
FIG. 2 is a view partially in plan and partially in longitudinal section through part of the weapon shown in FIG. 1, the section being taken on the line 2—2 in FIG. 1.

Both FIG. 1 and FIG. 2 are designated "PRIOR ART" in drawings.

Figure 3:
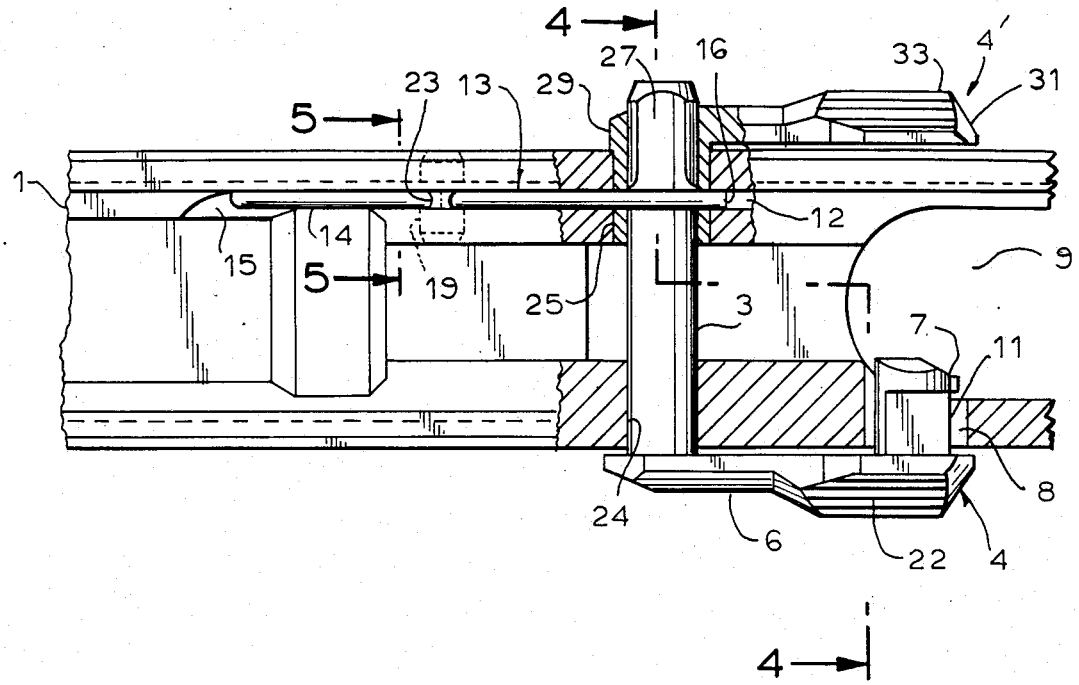
Figure 4:
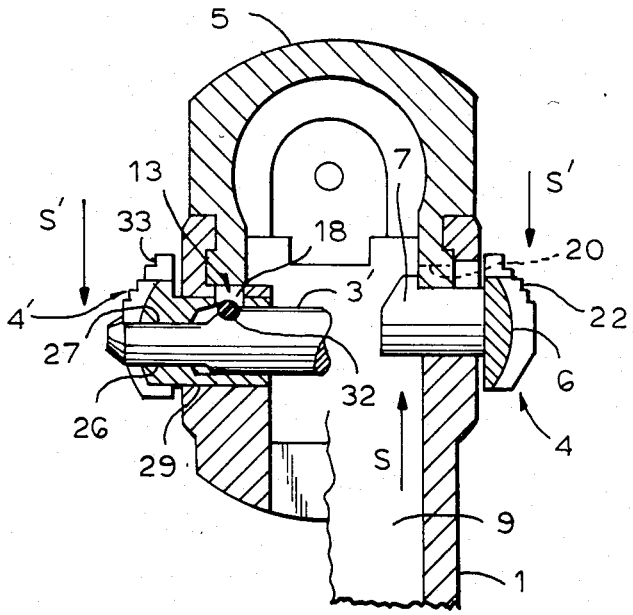

FIG. 3 is a view similar to FIG. 2, but showing the two-handed control for the slide detent in accordance with the invention including the mutual location of the first and the second control means;

FIG. 4 is a fragmentary view in broken transverse section through the device shown in FIG. 3, the section being taken along the line 4—4 in FIG. 3;

FIG. 5 is a fragmentary view in transverse section through a part of the frame of the weapon of FIG. 3, the section being taken along the line 5—5 in FIG. 3;

FIG. 6 is a fragmentary view partially in cross section and partially in side elevation, such section being taken along the line 6—6 in FIG. 3; and FIG. 7 corresponds to FIG. 1 and shows the improvement over the prior art.

Turning first to FIGS. 1 and 2, which illustrates a prior art machine pistol adapted for use by right-handed marksmen, such pistol has a frame 1 on top of which there is supported a horizontally reciprocal slide 5 which is of generally inverted U-shaped vertical section. The pisol has a handle of which a portion is shown in FIG. 1, such handle having an inner space 9 therewithin which receives a cartridge magazine 10. In opposite aligned holes 24, 25 (FIG. 4) in spaced side portions of frame 1, there is seated a cross pin 3 connected by a lever arm 6 to a catch or detent mechanism 4 which selectively cooperates with cooperating striker or latching means 20, 21 on the slide 5. The radially outer end of lever 6, has a knurled, thumb-engaging surface 22. The detent mechanism for the lever 6 are stably held in the position thereof shown in FIG. 1 by the interaction of an elongated spring 16 and a flat portion 18 on the pin 3. The spring 16 has its left hand portion (FIG. 1) received in a recess having a flat bottom 15, the spring 16 passing to the right beneath a cross pin 19 and lying partially in a circumferential groove 23 therein. The right hand end portion 13 of the spring 16 lies within a circumferential groove in the pin 3, thereby retaining the pin 3 from escape from the hole 24. The before mentioned flat 18 on the pin 3 with which the spring end portion 16 cooperates, lies within the upper part of said circumferential groove. The flat end portion 13 of spring 16 engages the flat on pin 3 and yieldably retains the pin in the angular position thereof shown in FIGS. 1 and 2.

The catch or detent means 4 has a laterally inwardly extending projection 7 on the radially outer end of the lever 6; portion 7 extending laterally inwardly through a passage 8 in the confronting side portion of the frame 1 of the pistol. Projection 7 has a sharp edge or claw 11 which selectively cooperates with a recess 21 of the slide 5, recess 21 having a vertical rear end surface 20 which engages the claw or detent member 11 on the catch 4 when the slide 5 is retracted to the rear (right) so that the claw 11 engages the vertical rear end surface 20 and retains the slide 5 against the constant thrust of resilient means (not shown) which urges the slide 5 to the left with respect to the frame 1. When the lever 6 is depressed by the thumb of a right-handed marksman, the claw 11 is depressed so as to escape from contact with the vertical surface 20, on slide 5, thereby allowing the slide 5 to move to the left extreme position whereby the cartridge is pushed onto the magazine 10 into a breechblock (not shown).

The detent control mechanism of the present invention, provided for the operation of the pistol by either right or left hand of a marksman, is shown in detail in FIGS. 3 to 7, inclusive. Parts shown in FIGS. 3 to 7, inclusive, which are the same as those shown in FIGS. 1 and 3 are designated by the same references characters.

The differences between the prior art pistol shown in FIGS. 1 and 2, and a pistol provided with the control mechanism for the detent in accordance with the invention, shown in FIGS. 3 to 7, inclusive, lie mainly in the provision of a second arm 31, similar to the arm 6, on the right hand side of the pistol, arm 31 having a knurled surface 33 on its radially outer end. Arm 31 is connected to the right hand end of a pin 3' in a manner to be described. The arm 31, the knurled surface 33, and the means for attaching arm 31 to the right hand end of the pin 3' constitute a second control means 4' for the catch or detent which interacts with the slide 5 of the pistol.

The pin 3' is somewhat longer than pin 3 shown in FIGS. 1 and 2, pin 3' extending a substantial distance beyond the right hand side of the body 1 of the pistol. The diameter of hole 25 through the right hand side of the pistol frame 1 is somewhat larger than that of the hole 24 (FIG. 2), hole 25 receiving a bushing or collar 29 which is integral with the radially inner end of the lever or arm 31. The right hand end of the pin 3' has two diametrically opposite parallel flats 26, 27 which interact with mating parallel flats 30 provided in the collar 29 (FIG. 6). The collar 29 has a part-cylindrical with the circumference of the collar 29 forming an edge 28. See FIG. 7. The slot 32 is aligned with the circumferential groove in the pin 3', whereby the right hand end of the spring 13 retains both the pin 3' and the collar 29 with its lever 31 from lateral escape from the pistol. The end portion 16 of spring 13 lies within a slot 12 and engages flat on pin 3' when the pin 3' is in the angular position thereof shown in FIG. 7. Between the flats 26, 27 on the pin 3' and the mating flats 30 in the collar 29 there is defined a play in such a manner that the spring 13 exerts a pressure on said edge 28 outside the center of the collar 29, whereby it turns the latter in clockwise direction. The force of the spring 13 or its portion 16 transferred from the edge 28 via flats 26, 27, 30 and the projection 7 onto the circumference of the passage 8 automatically defines a radial play between the two parts of the detent mechanism while an axial play is defined, due to the mounting of the spring portion 16 in the slot 12 of the frame and in the slot 32 as well as in circumferential slot in pin 3.

The device according to the invention operates as follows:

In FIG. 3 the control means for the detent for slide 5 are shown in the position before catching the breech in its back. In this position the portion 16 of the spring 13 lies in the slot 32 of the collar 29 and holds down the detent 4' in the rest position. After the last cartridge has been fired from the firearm, the feeder (not shown) of the cartridge magazine 10, pushed by a spring (not shown) in the magazine 10 provides a pressure on the projection 7, formed on the arm 6 (or lever) of the detent 4', and it deflects the elements 31 and 4' upwardly in the direction of arrow S (FIG. 4). Due to the motion of the detent 4' the claw 11 catches the vertical flat 20 on its back to hold the slide in its so-called "open-position".

After the empty magazine 10 has been taken out of the pistol and another magazine filled with cartridges has been inserted therein, it is sufficient now to press either the knurled surface 22 or the knurled surface 33 by the thumb of the hand by which the firearm is held in the direction of the arrow S' (FIG. 4) in this movement, the claw 11 of the detent 4' comes out engagement with the vertical surface 20 of the slide 5, which permits the slide 5 to move forwardly, and simultaneously it shifts a cartridge into the breechblock of the barrel of the pistol, so that the pisol is ready agains for firing.

Although the invention is illustrated and described with reference to one preferred embodiment thereof, it is by expressly understood that it is no way limited to the disclosure of such a preferred embodiment, but it is capable of numerous modifications within the scope of the appended claims.

We claim:

1. In an automatic firearm such as the automatic pistol, said firearm having a frame, a slide on the frame, a selectively operable detent for retaining the slide in retracted position on the frame, an oscillatable cross pin upon which the detent is mounted, a first frame control lever for the detent disposed upon a first side of the firearm, the control lever being fixedly connected to said oscillatable cross pin, said oscillatable cross pin having a circumferentially disposed transverse groove within the frame of the firearm, and an elongated spring within the frame of the firearm extending generally longitudinally thereof and having a portion seated in said transverse groove in said oscillatable cross pin so as to prevent the axial escape of said oscillatable cross pin from the frame of the firearm, the improvement comprising a collar slid on and removably attached to the end of said oscillatable cross pin remote from the first control lever, said collar being provided with a transverse slot disposed radially outwardly of said transverse groove in said oscillatable cross pin, the said portion of the spring seated in said transverse groove in said oscillatable cross pin passing through said transverse slot in the collar, and a second control lever fixedly connected to the collar and lying outwardly of the other, second side of the firearm.

2. An automatic firearm as claimed in claim 1, wherein the two control levers are similar in shape and are removably mounted in the same angular position with respect to said oscillatable cross pin.

3. The automatic firearm as claimed in claim 1 wherein each of the two control levers has a khurled, thumb-engageable surface on its radially outer end.

4. An automatic firearm such as a pistol comprising a frame, a horizontally reciprocal slide on the frame, a projection selectively controlled from both sides of the firearm for holding the slide in the retracted position on the frame, a swinging cross pin on which there is mounted, a control lever at the first side of a detent mechanism inclined to said first side of the firearm and being fixedly attached to said projection and to said swinging cross pin which is provided with a first oblique cross groove which is provided in conjunction with a second oblique cross groove on a collar drawn on the swinging cross pin, and removably attached to the end of the said swinging cross pin remote from the control lever at the first side of the detent mechanism, while the first oblique cross groove, in the swinging cross pin, and the second oblique cross groove, in the collar, and a third groove on the frame are engaged by an elongated spring by its end portion which prevents the swinging cross pin from axially falling out of the frame, and prevents the collar from falling out of the firearm when being disassembled while the opposite end portion of said elongated spring bears on the frame, an edge of the collar which forms a projection of the second oblique cross groove with the circumference of the collar and which is in permanent engagement with the end portion of the spring, the widths of all three grooves being selected so as to receive the springs while the definition of a radial play between a first carrying flat of the swinging cross pin and a second carrying flat of the collar is made so that the pressure of the end portion of the elongated spring acts on a bearing point of the edge, outside the center of the collar, whereby the latter is turned in the clockwise direction, while the force exerted by the end portion of the elongated spring is transferred from said bearing point of the edge via the carrying flats, the swinging cross pin and the projection to the circumference of an opening in the frame whereby there is automatically defined radial play between the control lever at the first side of a detent mechanism and a control lever on the second side of the firearm, which is fixedly connected to the collar, and removably connected with the swinging cross pin by means of the elongated spring, and is situated outside the second side of the firearm, an axial play being defined by the mounting of the elongated spring in the first, second and third grooves.

5. An automatic firearm as claimed in claim 4, wherein the first oblique cross groove has a depth which is smaller than the second oblique cross groove.

* * * * *

UNITED STATES PATENT AND TRADEMARK OFFICE

CERTIFICATE OF CORRECTION

PATENT NO. 4,681,020

DATED July 21, 1987

INVENTOR(S) Vaclav Polansky

It is certified that error appears in the above-identified patent and that said Letters Patent are hereby corrected as shown below:

Change inventor's name from "POLANECKY" to --POLANSKY--

Signed and Sealed this

Tenth Day of November, 1987

*Attest:*

*Attesting Officer*

DONALD J. QUIGG

*Commissioner of Patents and Trademarks*